US006350318B1

(12) United States Patent
Ruschak et al.

(10) Patent No.: US 6,350,318 B1
(45) Date of Patent: Feb. 26, 2002

(54) OPTIMIZED VERSATILE COATING HOPPER

(75) Inventors: Kenneth J. Ruschak, Rochester; Daniel J. Suter, Penfield; Steven J. Weinstein, Fairport, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/213,795

(22) Filed: Dec. 17, 1998

(51) Int. Cl.[7] ..... B05C 5/00
(52) U.S. Cl. ..... 118/411; 118/DIG. 4
(58) Field of Search ..... 118/410, 411, 118/325, 412, DIG. 2, DIG. 4; 427/420, 402

(56) References Cited

U.S. PATENT DOCUMENTS

| | | | | |
|---|---|---|---|---|
| 3,005,440 | A | 10/1961 | Padday | 118/412 |
| 4,222,343 | A | 9/1980 | Zimmermann et al. | 118/325 |
| 4,285,655 | A | 8/1981 | Matsubara | 425/461 |
| 5,143,758 | A | 9/1992 | Devine | 427/420 |
| 5,234,500 | A | 8/1993 | Korokeyi | 118/325 |
| 5,234,649 | A | 8/1993 | Cloeren | 264/171 |
| 5,256,052 | A | 10/1993 | Cloeren | 425/133.5 |
| 5,376,401 | A | 12/1994 | Conroy et al. | 427/8 |
| 5,494,429 | A | 2/1996 | Wilson et al. | 425/192 R |
| 5,593,734 | A | 1/1997 | Yuan et al. | 427/420 |
| 5,643,363 | A | 7/1997 | Hosogaya et al. | 118/410 |

*Primary Examiner*—Brenda A. Lamb
(74) *Attorney, Agent, or Firm*—Mark G. Bocchetti

(57) ABSTRACT

A versatile, multiple-slot, dual cavity, slide/extrusion hopper for assembling and coating a composite layer comprising a plurality of highly uniform, superposed compositions, and a method for determining the dimensions of the hopper are disclosed. The hopper is suitable for photographic applications and other applications requiring highly uniform layers. The hopper is versatile in that it can accommodate coating compositions that range from Newtonian to substantially shear thinning and in that fewer than the total number of elements may be supplied; the slide offsets between elements are suitable for both merging layers and for the top layer alone. The height of the secondary slot is preferably greater than the height of the primary slot. The method provides optimal cross-sectional shapes for the cavities. Versatility is achieved without greatly increasing the height or thickness of the elements. A formula is provided which gives a straightforward and useful way to determine and scale versatile designs and thereby eliminate much experimentation and reduce the number of coating hoppers required.

7 Claims, 7 Drawing Sheets

OPTIMIZED VERSATILE COATING HOPPER

FIELD OF THE INVENTION

The present invention relates to apparatus for coating a liquid composition onto a substrate surface to form a coating thereupon and a method for determining the physical parameters of and making said hopper and, more particularly to a hopper for coating one or more liquid compositions from a plurality of distribution slots onto a substrate surface to form a coating, and most particularly to a multiple-slide hopper having a plurality of internal distributional cavities, internal slots, distribution slots, slide surfaces, and offsets between slide surfaces wherein the shapes of and relationships among these elements are optimized to permit transversely-uniform coatings of compositions having a wide range of Newtonian and shear-thinning Theological properties.

BACKGROUND OF THE INVENTION

In forming a flowing sheet of a liquid composition for coating onto a substrate surface, the composition is reshaped typically from collimated flow in a pipe to sheet flow for application by an apparatus known variously in the art as a die, a distributor, an extruder, and a hopper. As used herein, all such types of apparatus are referred to collectively as hoppers. A hopper may comprise one or more parallel longitudinal members which are oriented transversely of the direction of liquid flow, which members may be bolted together or otherwise attached to form a hopper unit. A primary member may be referred to as a "hopper body," and one or more secondary members as"hopper bars." Within a hopper, a flow path for liquid composition typically includes an inlet, one or more transverse distributional voids known as cavities or channels, and a slotted exit from each cavity communicating with either a successive cavity or the exterior of the hopper. The last such slot in the flow path is commonly known as an exit slot.

In extrusion/slide hoppers, as are used typically in the manufacture of photographic films and papers, composition is extruded upwards from the exit slot onto an inclined slide surface terminating at a lower edge in a coating lip. The extruded sheet flows down the slide surface under gravity and is transferred to the passing substrate either through a dynamic longitudinal bead, as in bead coating, or a falling curtain, as in curtain coating.

It is well known that a hopper unit may combine a plurality of individual distribution systems to permit the simultaneous application of a plurality of compositions and/or the split flows of a single composition having an exceptionally high flow rate (see, for example, U.S. Pat. No. 5,143,758 issued Sep. 1, 1992 to Devine). Such a hopper is known in the art as a multiple-slot hopper. The full stack of compositions to be coated is assembled as the liquids flowing from the exit slots of the individual distribution systems progressively become stacked on the hopper slides, each additional liquid sheet becoming the bottom-layer conveyance for the already-assembled stack of sheets sliding onto it from higher on the inclined hopper surface.

It is known that each slide surface is preferably offset vertically from (generally slightly lower than) the surface of the next slide farther from the substrate, to accommodate the new flow being added to the bottom of the stack. If an offset is too small or too large, the layers may not join smoothly; in particular, eddies and bubble traps may form that can result in nonuniformly coated layers. In the extreme, the sliding layers can form stable longitudinal ridges at an offset that is too high. Means for determining the optimum offset to accommodate a wide range of Newtonian and non-Newtonian rheologies has not heretofore been disclosed.

The slide surface of an extrusion/slide hopper terminates immediately above the uppermost slot in a wall, or "backland," for attachment of the free upper surface of the coating pack. It is known that if the backland is too high, attachment may occur irregularly along the vertical face of the wall and cause streaks; moreover, the upwardly curved meniscus traps bubbles. If the backland is too low, such attachment occurs irregularly along the hopper surface above the backland. A proper height backland permits the upper layer to attach uniformly at the well-defined upper edge of the backland while minimizing the risk of trapping bubbles. Typically, backlands may be about 2.5 mm high; however, means for determining the optimum backland height have not heretofore been disclosed.

It is standard practice in the coating art to fill all the slots in a hopper in use. Thus, for example, if a four-composition coating is to follow a five-composition coating using a five-slot hopper, either a four-slot hopper must be substituted between coatings or one of the compositions in the second coating must be split and delivered through two adjacent slots (See U.S. Pat. No. 5,143,758 supra). The former alternative requires the building of two entirely separate, expensive hopper units. In a large manufacturing practice, a large fleet of hoppers having different numbers of delivery slots may be required, which can be very expensive to fabricate and maintain. The latter alternative can require undesirably low flow rates through some slots or undesirable dilution of layers to artificially increase flow rates.

An alternative, not successfully practiced heretofore, is to use only the number of slots that is optimal for the compositions to be coated. In the above example, the fifth slot of the five-slot hopper could be left empty for the second coating if advantageous. A serious practical problem arises in so doing, however, as the fifth/fourth slide offset must now function as the backland, and typically such offset is substantially smaller than that conventionally used for a backland. Such a hopper, therefore, is not properly versatile.

Means for determining an acceptable height for an offset which can function either as a flow offset within a coating stack or as a backland at the top of a hopper slide, to increase the versatility of a hopper, has not heretofore been disclosed.

Distribution arrangements for each flow within a hopper typically include a flared central inlet (see, for example, U.S. Pat. No. 5,256,052 issued Oct. 26, 1993 to Cloeren) connecting a feed pipe to the center of a generally bilaterally-symmetrical first distributional cavity disposed transversely of the required sheet flow and web conveyance direction. A first slot connects the first cavity with a second cavity generally parallel with the first cavity. A second slot connects the second cavity with the slide surface of the hopper. Such a hopper may be referred to in the art as a "dual cavity" hopper having a primary cavity and slot and a secondary cavity and slot.

The functions of these hopper flow elements are as follows. The inlet is flared downstream where it joins the first cavity to begin the conversion of composition flow from flow in a conduit to cavity flow transversely of the direction of coating. The first or primary cavity provides the initial and principal widthwise distribution of composition. Because velocity is lost as the liquid flows along a cavity of constant cross-sectional area, the primary cavity preferably is tapered in continuously-declining cross-sectional area between the center and the two ends (See, for example, U.S. Pat. No.

4,285,655 issued Aug. 25, 1981 to Matsubara; U.S. Pat. No. 5,234,649 issued Aug. 10, 1993 to Cloeren; and U.S. Pat. No. 5,494,429 issued Feb. 27, 1996 to Wilson et al). The cross-sectional shape may be generally circular, generally rectangular, or a combination of the two (See, for example, U.S. Pat. No. 4,222,343 issued Sep. 16, 1980 to Zimmermann et al.; U.S. Pat. No. 5,256,052 issued Oct. 26, 1993 to Cloeren; U.S. Pat. No. 5,593,734 issued Jan. 14, 1997 to Yuan et al.; and U.S. Pat. No. 5,643,363 issued Jul. 1, 1997 to Hosogaya et al).

The slot adjoining the primary cavity, the primary slot, is small enough in height, typically about 0.025 cm or less, to create a substantial back pressure in the primary cavity. The length of the slot between the cavities may be constant or may be tapered to compensate for pressure loss along the primary cavity. The primary cavity and slot cooperate to provide into the secondary cavity a flow of composition in the coating direction that is nearly uniform in flow per unit of coated width.

The secondary cavity permits smoothing of the widthwise pressure gradient such that flow pressure presented to the secondary slot is highly uniform across the entire width of the slot. The secondary slot has a precisely uniform length, and so the flow distribution is highly uniform. Preferably, the secondary cavity is configured to smooth transverse pressure gradients without formation of eddies or stagnant regions within the cavity (See, for example, U.S. Pat. No. 5,234,500 issued Aug. 10, 1993 to Korokeyi, the disclosure of which is hereby incorporated by reference).

The secondary slot has a uniform length between the secondary cavity and the slide surface and a uniform height, for example, 0.025 cm. The slot exit may be simply the end of the slot itself, or it may be an expansion (for example, U.S. Pat. No. 3,005,440 to Padday).

Means for determining the combined optimum parameters for the primary cavity, primary slot, secondary cavity, and secondary slot have not heretofore been disclosed.

It is known in single-slot hoppers to adjust the height of a slot, as by bending the bars using adjusting bolts, to fine-tune flow uniformity therefrom. Such tuning is not practically possible in multiple-slot hoppers, because individual bars are not accessible for loading and because mechanical distortion affects more than one slot.

Also, it is known in single-slot hoppers to specialize the internal design for specific rheological and flow conditions. This stratagem is not attractive for multiple slot hoppers. Therefore, in known multiple-slot hoppers, typically the same parameters are used for designing and fabricating each flow system so that all individual distribution systems are geometrically identical. This is attractive because of the wide range of flow conditions that each system must accommodate in day-to-day operation. It has been possible, of course, to design and fabricate each distribution system to be optimum for a specific flow rate of a specific coating composition, but such a hopper then becomes dedicated to use with a particular combination of compositions (a product). Such specialization is very expensive for each custom hopper, and back-up equipment can be provided only at double the expense. For an establishment that manufactures many coated products having significantly different numbers of compositions having differing rheological properties and flow rates, such specialization is clearly not feasible.

Therefore, hopper flow systems typically are designed to accommodate some ranges of rheological properties and flow rates. In recent years, the range of conditions that needs to be accommodated has expanded considerably; the reasons include increases in coating speed and more severely shear-thinning coating compositions. At one extreme, hoppers for photographic products must accommodate Newtonian rheology; aqueous gelatin, the common vehicle for photographic compositions, is Newtonian or nearly so in hoppers. At the other extreme, coating compositions can be significantly shear thinning; that is, viscosity decreases with an increasing rate of shearing. Photographic compositions contain emulsions and dispersions, and such colloids impart shear thinning behavior as they are concentrated, as by a reduction in the solvent (water) to extend the capabilities of existing dryers. Viscosity enhancing agents, usually called thickeners, are also increasingly used. Most often these are polymers of high molecular weight that physically crosslink with gelatin molecules, and they almost always promote shear thinning. Thus, known hoppers lack adequate versatility.

A significant restriction in hopper design is the total height of the bars. Existing coating stations may severely restrict an increase in bar height to accommodate a more versatile design. In curtain coating, bar height is usually restricted by curtain height. In any case, taller bars increase hopper weight making transport and positioning more difficult. Taller bars also increase the leverage of internal liquid pressures for bending the bars and compromising slot height. Taller bars may have to be thicker to increase their stiffness, but thicker bars increase hopper weight and the length of the hopper slide. As superimposed layers flow down the hopper slide, waves arise because of mechanical vibrations and flow-rate pulsations (for example, U.S. Pat. No. 5,376,401). Flow down the slide may amplify any such waves, and the longer the slide the greater the amplification. Thus, it is known to minimize slide length, and thicker bars oppose that aim.

Thus there is a need for a method to determine, for a wide range of flow rates and Newtonian and shear-thinning Theological conditions, the optimum dimensions of elements of a versatile dual-cavity extrusion/slide hopper, including primary cavity shape and size in three dimensions, primary slot height, length and taper, secondary cavity shape and size in three dimensions, secondary slot height and length, and slide offset at a slot exit. The versatility cannot come at the expense of a large increase in bar height or thickness.

SUMMARY OF THE INVENTION

It is a principal object of the invention to provide a method for determining a versatile, dual-cavity, multiple-slot extrusion/slide hopper.

It is a further object of the invention to provide an improved multiple-slot hopper wherein uniformity of liquid composition delivery from each slot is maximized in the widthwise direction.

It is a still further object of the invention to provide an improved multiple-slot hopper wherein the parameters and consequent physical dimensions of all composition distribution systems are identical.

It is a still further object of the invention to provide versatility without greatly increasing bar height, hopper weight, or slide length.

It is a still further object of the invention to provide an improved hopper wherein each slide offset can function either as a flow offset within a coating stack or as a suitable backland at the top of a coating stack.

The invention is defined by the claims. The apparatus and method of the invention are useful in providing highly uniform coatings of liquid compositions to moving webs over a wide range of flow rates and of Newtonian and shear-thinning rheologies.

Briefly described, the invention includes a versatile, multiple-slot, dual cavity, slide/extrusion hopper for assembling and coating a highly uniform composite layer comprising a plurality of superposed compositions, and a method for designing the hopper such that each extruded flow is highly uniform in thickness, slide offsets can function as flow offsets within the coating stack or as a suitable backland at the top of the utilized slide, each slide offset is sized to prevent eddies and bubble trap formation, and all individual flow systems within the hopper are geometrically identical. The method provides the optimum cavity cross-sectional shape and rate of taper for the primary cavity, the optimum height, length, and rate of taper for the primary slot, the optimum cavity cross-sectional shape for the secondary cavity, and the optimum height and length for the secondary slot, and the optimum slide offset height. A formula is provided which gives a straightforward and useful way to scale versatile designs and thereby eliminate much experimentation and design effort and reduce the number of coating hoppers required.

The method for determining the physical parameters of flow controlling elements within a coating hopper comprises the steps of:

a) specifying values for rheological parameters of the most shear thinning liquid composition to be dispensed according to the truncated power-law model, including the viscosity at low shear rates ($\mu_l$), the viscosity at high shear rates ($\mu_h$), the power law index (n), the shear rate above which shear thinning occurs ($\dot{\gamma}_l$), and the maximum volumetric flow rate per unit coated width (q)of said composition to be supplied to one of said elements, said rheological parameters conforming to the limits $n \geqq 0.6$ and $\dot{\gamma}_1 \geqq 100$ per sec;

b) specifying values of the following physical parameters: the half-width of the hopper cavities (L), the initial length of the primary slot ($l_p$) from about 0.5 to about 2 cm, the initial length of the secondary slot ($l_s$) from about 1.0 to about 2.5 cm, the height of the primary slot ($h_p$) from about 0.018 to about 0.030 cm, the height of the secondary slot ( $h_s$)from about 0.038 to about 0.076 cm, the exponent by which the cross section of the primary cavity is tapered (t) from about 0.4 to about 0.6; the primary design factor ($E_p$) from about 0.005 to about 0.1, the secondary design factor ($E_s$) from about 0.1 to about 0.3, the aspect ratio of the cross section of the primary cavity ($r_p$) from about 1 to about 2 and determining the ratio of the area to the square of the flow length ($\beta_p$) for said cross section of said primary cavity, the aspect ratio of the cross section of the secondary cavity ($r_s$) from about 2 to about 7 and determining the ratio of the area to the square of the flow length ($\beta_p$) for said cross section of said secondary cavity;

c) calculating from said specified physical and said rheological parameters the values of the primary viscosity ratio ($f_p$) where $$f_p = \frac{6q^{1-n}}{\dot{\gamma}_l^{1-n} h_p^{2(1-n)}} \left[\frac{n}{2(2n+1)}\right]^n,$$

and the secondary viscosity ratio ($f_s$) where $$f_s = \frac{6q^{1-n}}{\dot{\gamma}_l^{1-n} h_s^{2(1-n)}} \left[\frac{n}{2(2n+1)}\right]^n;$$

d) calculating values for the remaining of said physical parameters using values obtained in steps a) through c), said remaining physical parameters including the primary geometry ratio ($g_p$) where $g_p=(1-t)E_p/(f_p-1)$ and $g_p \leqq 0.07(1-t)$, the secondary geometry ratio ($g_s$) where $g_{s=Es}/f_s$, the initial cross-sectional area of the primary cavity ($A_p$) where $A_p=\sqrt{h_p^3 L^2/l_p g_p}$, the initial flow length of the primary cavity ($b_{p)\ where\ bp}=\sqrt{A_p/\beta_p}$, the fractional tapering of the primary slot (m) where $m=1-g_p(1+f_p)/1.5(1-t)$, the cross-sectional area of the secondary cavity ($A_s$) where $A_s=\sqrt{h_s^3 L^2/l_s g_s}$, and the flow length of the secondary cavity ($b_s$) where $b_s=\sqrt{A_s/\beta_s}$.

The coating hopper of the present invention dispenses a liquid composition to coat a moving substrate. The coating hopper comprises a primary cavity, a primary slot exiting the primary cavity and communicating with a secondary cavity, and a secondary slot exiting the secondary cavity, wherein, preferably, the primary slot height $h_p$ is between about 0.018 cm and 0.030 cm, the secondary slot height is between about 0.038 cm and 0.076 cm, the primary slot length is between about 0.5 cm and 2 cm, the secondary slot length is between about 1 cm and 2.5 cm, the a tapering factor t is between about 0.4 and 0.6, the aspect ratio of the primary cavity ($r_p$) is between about 1 and 2, the aspect ratio of the secondary cavity is between about 2 and 7, the primary geometry ratio ($g_p$) is between about 0.001 and 0.04, the secondary geometry ratio ($g_s$) is between about 0.03 and 0.3, and the fractional tapering of the primary slot (m) is between 0.9 and 1.

BRIEF DESCRIPTION OF THE DRAWINGS

The foregoing and other objectives, features, and advantages of the invention will be apparent from the following more particular description, including the presently preferred embodiments of the invention, as illustrated in the accompanying drawings in which.

DETAILED DESCRIPTION OF THE INVENTION

Hoppers in accordance with the invention are versatile in two ways: first, in their capability for use with fewer layers than the number of slots available (intermediate slide offsets may function as backlands for top layers); and second, in their capability for delivering a wide range of both Newtonian and shear-thinning compositions to form layers having a high degree of widthwise thickness uniformity. Hoppers in accordance with the invention accomplish this versatility without greatly increasing the height of the hopper bars.

Figure 1:
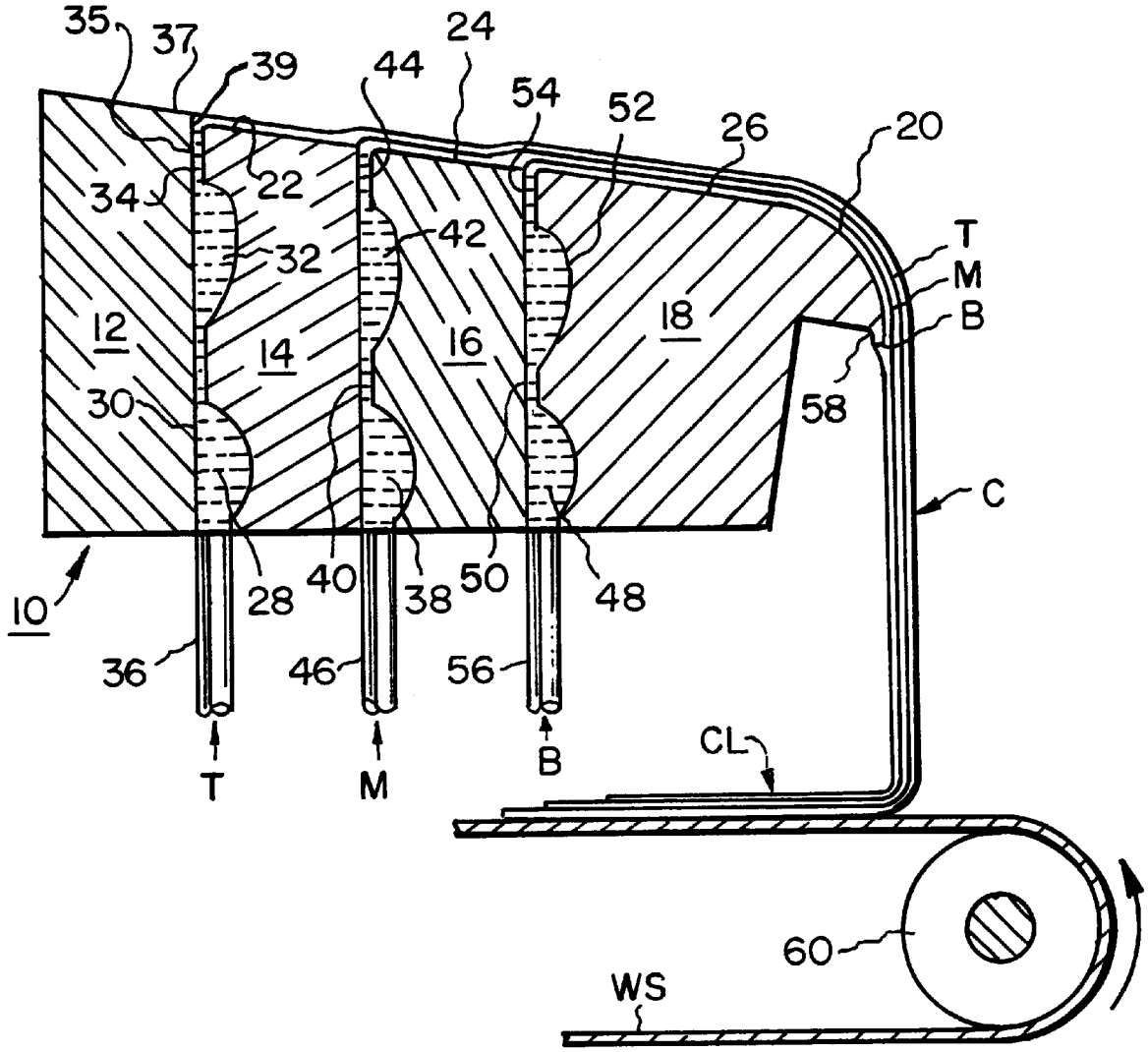
FIG. 1 (PRIOR ART)
FIG. 1 is an elevational cross-sectional view of a prior art multiple-slot, dual-cavity, extrusion/slide hopper, shown applying a three-component composite layer by curtain coating to a moving web substrate.
Figure 2:
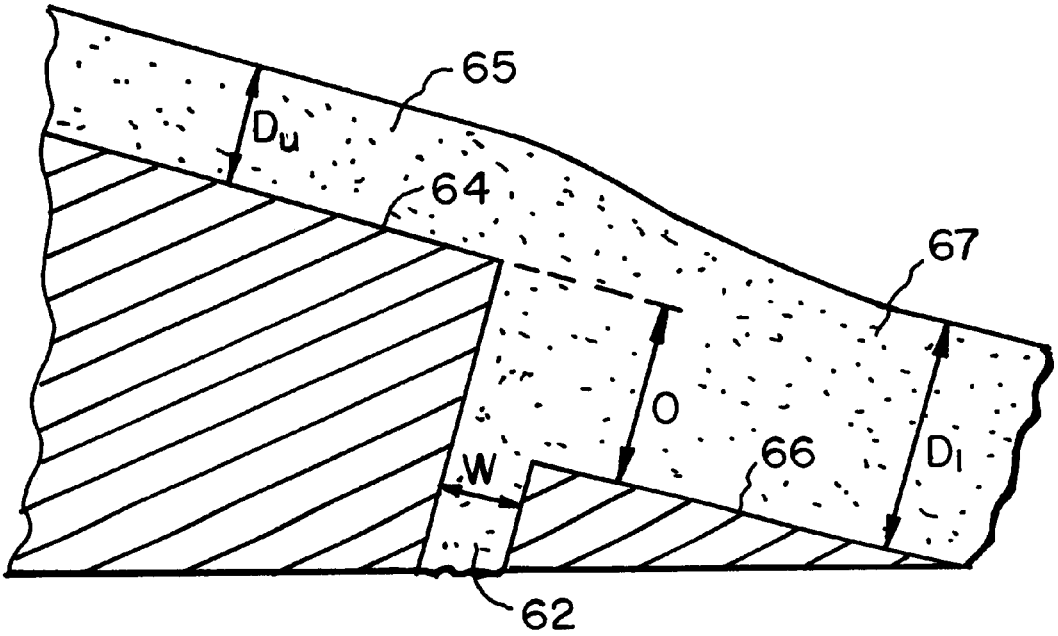
FIG. 2 is a schematic elevational cross-sectional view of a portion of a hopper, showing important parameters of the invention, $D_l$, $D_u$, W, and O.

FIG. 1 shows a multiple-slot, dual-cavity, extrusion/slide hopper in accordance with the prior art. The following description of the components and relationships within a known hopper can help in understanding novel methods and apparatus in accordance with the invention.

Hopper 10 includes hopper bars 12,14,16, and curtain-forming bar 18 having a lip portion 20. Bars 14,16,18 have upper planar surfaces 22,24,26, respectively, herein referred to as "slides" or "slide surfaces," which together form a wide incline at an angle θ of from about 5 to 20 degrees from horizontal. The slide surfaces are parallel but not necessarily coplanar.

The spaces between bars 12,14,16,18 form passages for supplying photographic compositions to the incline formed by the slide surfaces. For top composition T, this passage is defined by the space between bars 12 and 14 and includes primary cavity 28, primary slot 30, secondary cavity 32, and secondary slot 34, all of which extend substantially all the way across the width of hopper 10. The flow region cannot be mechanically interrupted, and so the bars abut one another only below the primary cavity and outside the ends of the cavities. Liquid composition T is provided to cavity 28 by feed conduit 36 which has a central or side location relative to the transverse extent of cavity 28 across hopper 10. Preferably, the feed conduit is precisely centered and primary cavity 28 is symmetrical about center. A vertical extension of upper side 35 of exit slot 34 beyond the plane of surface 22 defines a backland 39 for containing composition T. (In the discussion infra of methods and apparatus in accordance with the invention, the above item numbers are used for the analogous respective hopper flow distribution components.) For middle liquid composition M, the analogous components are primary cavity 38, primary slot 40, secondary cavity 42, secondary slot 44, and feed conduit 46. For bottom liquid composition B, the analogous components are primary cavity 48, primary slot 50, secondary cavity 52, secondary slot 54, and feed conduit 56.

Typically, known primary cavities are rounded in cross section and are tapered in cross-sectional area from the inlet to the distal end; known secondary cavities are also rounded, for example, semicircular, in cross section and are not tapered; and primary and secondary slots are the same height, about 0.25 mm. The height of the primary slot $h_p$ is defined as the distance between adjacent hopper bars in the region of the slot, e.g., bars 12 and 14, 14 and 16, and 16 and 18. The height of the secondary slot $h_s$ is similarly defined.

In operation, compositions T,M,B are extruded from exit slots 34,44,54, respectively, onto slides 22,24,26, respectively. Top composition T wets backland 39 to the juncture of side 35 and upper surface 37. The layered aggregate of compositions T,M,B advances downwardly under gravity along the inclined slide surfaces without substantial interlayer mixing; flow is laminar (smooth) and mixing is by molecular diffusion only. Waves on the slide are prevented by minimizing mechanical vibrations of the hopper and flow pulsations in the delivery systems. Viscosities and flow rates of the layers are determined, as part of product design, to minimize the amplification of waves as is the natural tendency of inclined flow. From lip 58, these liquid layers fall as a continuous curtain C onto web substrate WS to form a coated composite layer CL. Web substrate WS is backed by roller 60, which may also be a drive roller, and is advanced continuously past the point at which the web is impinged by curtain C.

The following flow conditions must be specified or determined for subsequent use in the algorithm in accordance with the invention.

$q_u$ flow rate per unit width of the composite layer, upper slide q flow rate per unit width exiting the slot onto the slide $q_l$ flow rate per unit width of the composite layer, lower slide $D_u$ thickness of the composite layer, upper slide $D_l$ thickness of the composite layer, lower slide $\mu_s$ viscosity in the secondary slot ρdensity Re slot Reynolds number (computed)

O slide offset $h_s$ height of secondary slot

θangular inclination of the slide from horizontal

Figure 13:
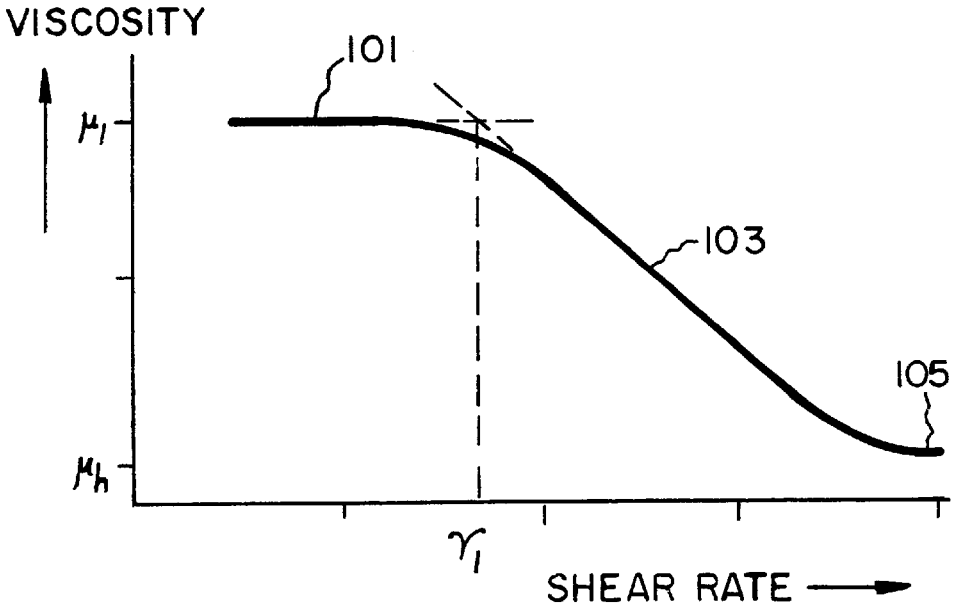
FIG. 13 is a generic shear/viscosity curve for a non-Newtonian (shear thinning) liquid composition.

With few exceptions, the rheology of photographic compositions for flow inside the hopper or on the hopper slide is either Newtonian or shear thinning. A Newtonian composition is characterized by its viscosity, $\mu$, and density, ρ. For a shear-thinning composition, viscosity depends upon shear rate, as illustrated in FIG. 13. The following intrinsic properties of a liquid composition are readily determinable through use of a commercially-available viscometer or rheometer and can be displayed graphically in a shear/viscosity curve like that shown in FIG. 13, wherein viscosity in units of poise is a function of the rate of shear applied to the composition in units of inverse seconds. For purposes of the invention, a range of shear rates extending to about 10,000 per sec is adequate. The viscosity curve is customarily plotted on logarithmic coordinates and generally comprises three regions: a low shear region 101 wherein viscosity is relatively high and constant; an intermediate shear region 103 wherein viscosity diminishes as a result of increasing shear; and a high shear region 105 wherein viscosity is relatively low and constant. As measured on real compositions, and shown in FIG. 13, these regions are not sharply defined, the curve rounding from one region into the next. For the purposes of the invention, the curve of viscosity versus shear rate of FIG. 13 is approximated by the truncated power-law model also illustrated in FIG. 13. The truncated power-law model has sharp transitions, a useful approximation providing simplicity.

$\mu_l$ viscosity at low shear $\mu_h$ viscosity at high shear $\gamma$ shear rate n power law index M consistency of the liquid $\rho$ density of the liquid The straight-line portion of the data curve on logarithmic coordinates is called the power-law region and is described by the equation $$\mu = \frac{M}{\dot{\gamma}^{1-n}} \quad \text{Eq. 1}$$

Values for M and n are chosen to fit the measured viscosity values in the straight-line region of the data. As an approximation, the power-law line is extrapolated to the values $\mu_h$ and $\mu_l$ and truncated there, as FIG. 13 shows. So, the intersection of the power-law equation, Eq. 1, with $\mu_l$ and $\mu_h$ gives the shear rate range $\dot{\gamma}_l \geqq \dot{\gamma} \geqq \dot{\Gamma}_h$ for shear thinning, where $$\dot{\gamma}_l = (M/\mu_l)^{\frac{1}{1-n}} \quad \text{and} \quad \dot{\gamma}_h = (M/\mu_h)^{\frac{1}{1-n}}.$$

Thus, the truncated power-law model-approximates the experimental curve of viscosity versus shear rate on logarithmic axes by three straight lines. U.S. Pat. No. 5,143,758 issued Sep. 1, 1992 to Devine teaches that to minimize the risk of streak nonuniformities, the slot Reynolds number should have a value of 10 or less. For shear-thinning compositions, an average viscosity $\mu_s$ in the secondary slot for the computation of slot Reynolds number can be computed as $$\mu_s = \max\left[\min\left\{\frac{M}{6}\left[\frac{2(2n+1)}{n}\right]^n \frac{h_s^{2-2n}}{q^{1-n}}, \mu_l\right\}, \mu_h\right] \quad \text{Eq. 2}$$

in which q is the volumetric flow rate per unit width through the slot and $h_s$ is the secondary slot height. This expression says that the value of the average viscosity cannot be greater than the low-shear viscosity or smaller than the high-shear viscosity. Devine's condition then becomes $$Re = \frac{\rho q}{\mu_s} \leq 10 \quad \text{Eq. 3}$$

If this condition is violated, the composition can be distributed to two or more slots. It may also be possible to comply by changing other conditions affecting the Reynolds number, such as coating speed, as also taught by Devine.

The optimization of slide offsets and backland heights is considered first. In FIGS. 2 through 6 detailed generic relationships of a secondary slot exit 62 and adjacent slides 64,66 are shown. Slot 62 is usually precisely perpendicular to slide 64,66. W is the final height of the exit slot and can exceed the secondary slot height $h_s$ (not shown) if the slot is expanded at its end as may be provided for known hoppers (for example, U.S. Pat. No. 3,005,440 to Padday). O is the height of the offset between slides 64 and 66. The thickness of the composite layer 65 on slide 64 above the slot exit is $D_u$, and the thickness of the composite layer 67 on slide 66 below the slot exit is $D_l$. In the practice of the invention, these thicknesses are computed thicknesses, as described infra.

For relatively large offsets O, the air interface is substantially curved in the vicinity of the slot exit. Emerging layers can develop broad streaks, a couple of centimeters or so wide, at an offset. When fully developed, these streaks are spatially periodic, and the meniscus over the slot exit is corrugated. This phenomenon is referred to herein as slide ribbing. A coating CL may show irregular streakiness even before the onset of well-defined slide ribbing, and this streakiness has been traced to the existence of an eddy 68 adjacent to slide surface 64 just above the exit of slot 62. Further, bubbles 70 may be trapped both above and over the slot exit, before the onset of either the offset eddy or slide ribbing.

The possibility of trapping bubbles is a first undesirable consequence of a slide offset that is too high. Thus, we have determined, as described infra, the conditions under which bubbles may not be trapped at a slot exit.

Figure 3:
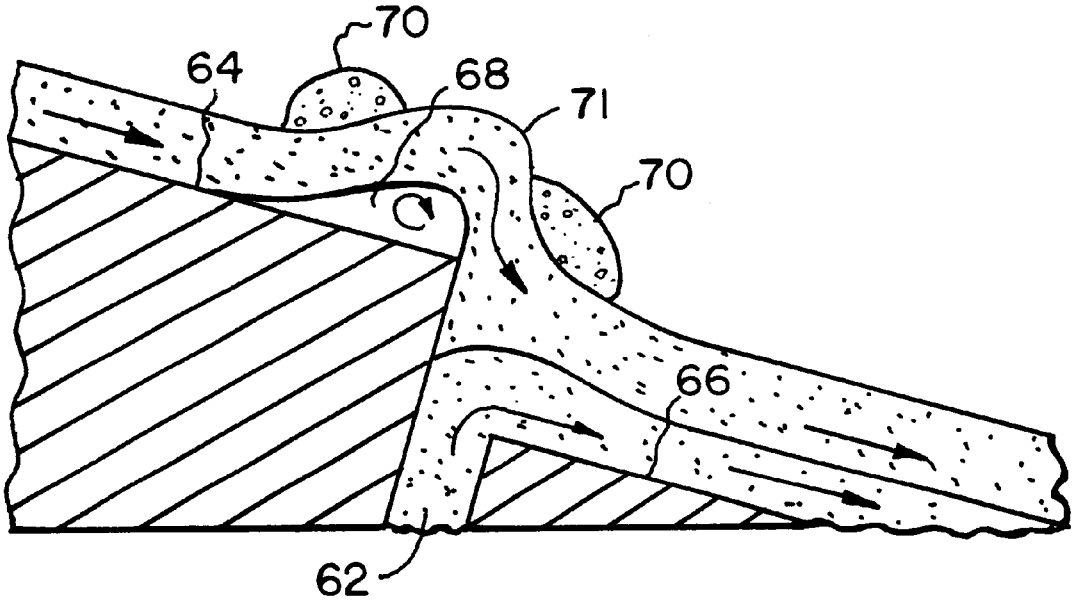
FIG. 3 is a view like that of FIG. 2, showing the positions of eddies and bubble traps on a hopper slide.
Figure 4:
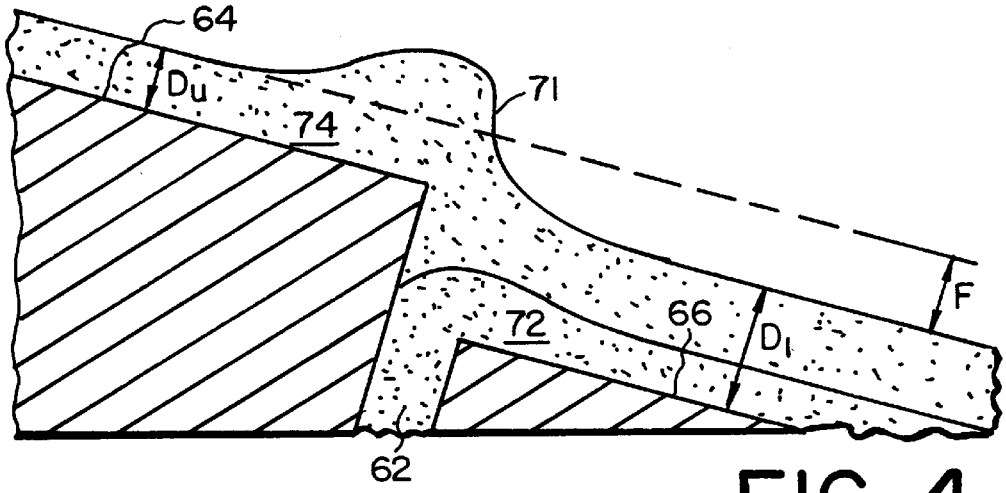
FIG. 4 is a view like that shown in FIG. 3, showing the parameters F, $D_l$ and $D_u$.
Figure 5:
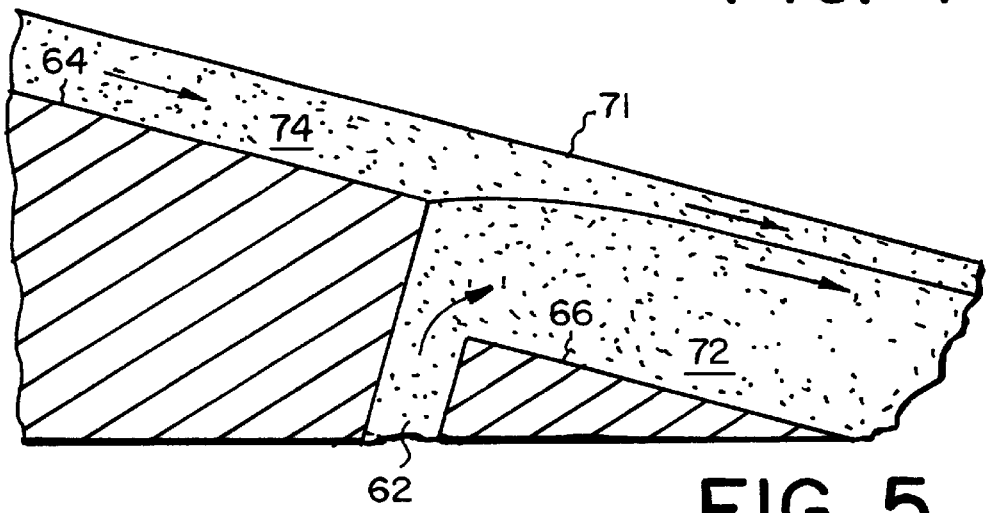
FIG. 5 is a view like that shown in FIG. 4, showing flow relationships when F=0.
Figure 6:
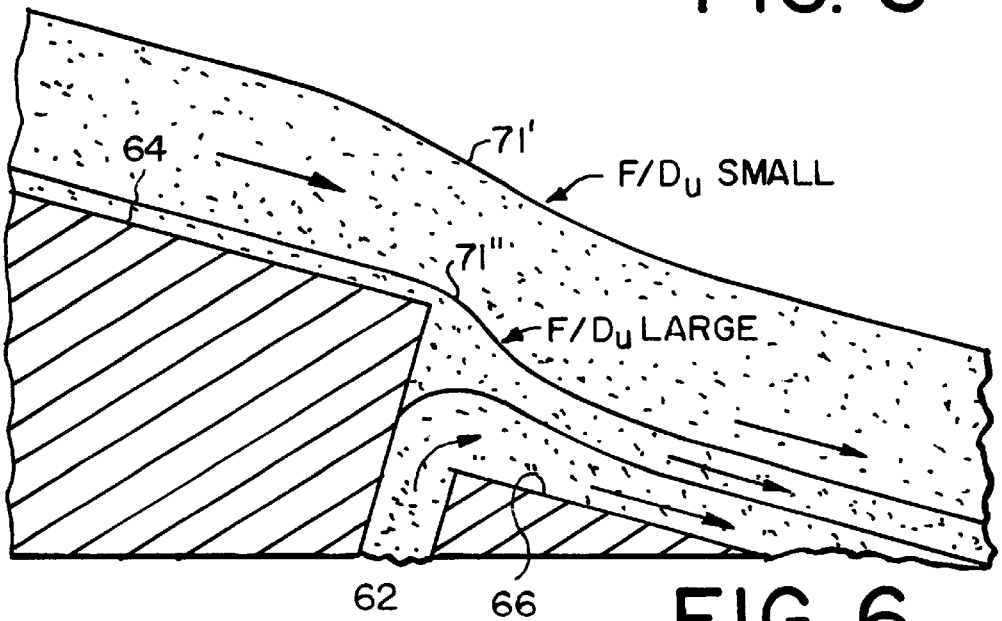
FIG. 6 is a view like that shown in FIG. 4, showing flow relationships when $F/D_u$ is relatively small and when $F/D_u$ is relatively large.

FIG. 3 shows flow over an offset with a substantially non-planar meniscus 71. Some measure of non-planarity is not adverse, but beyond a certain degree the problems recited previously arise. Above and below the slot exit, the meniscus is flat and parallel to the slide but in different planes that are parallel but offset by a distance F, as shown in FIG. 4. If the surface offset F is substantially zero, as shown in FIG. 5, and if the liquid exiting the exit slot is not jetting, as ensured by the restriction on the value of the slot Reynolds number taught by Devine and discussed supra, then the entire meniscus 71 is substantially flat and no bubbles can be trapped. However, if F is large, as shown in FIG. 4, then the meniscus is highly nonplanar and is capable of trapping bubbles. F may be expressed in terms of the slide offset O and composite-layer thicknesses on the slide element above the exit, $D_u$, and on the slide element below the exit, $D_l$:

$$F = O + D_u - D_l \quad \text{Eq. 4}$$

For the purpose of the invention, thickness on the slide is computed. For a single layer, thickness on the slide D for a Newtonian composition is given by $$D = \left[\frac{3\mu q}{\rho G \sin(\theta)}\right]^{\frac{1}{3}} \quad \text{Eq. 5}$$

wherein D is thickness on the slide, $\mu$ is viscosity, q is volumetric flow rate per unit width, $\rho$ is density, G is gravitational acceleration, and $\theta$ is the angle of inclination of the slide from horizontal. The formula for thickness on the slide for a single, shear-thinning composition is $$D = \left[q\left(2 + \frac{1}{n}\right)\left(\frac{M}{\rho G \sin(\theta)}\right)^{\frac{1}{n}}\right]^{\frac{1}{(2+\frac{1}{n})}} \quad \text{Eq. 6}$$

It may be that shear rates on the slide are so low that the shear-thinning composition has uniform viscosity $\mu_l$; this is commonly the case for aqueous gelatin for example. So the thickness according to Eq. 6 is compared to that computed by Eq. 5 using $\mu_l$, and the lower value for thickness is used. It is less likely that shear rates on the slide are so high that the shear-thinning composition has uniform viscosity $\mu_h$. The thickness according to the power-law model is compared to that computed by the Newtonian formula using $\mu_h$. and the higher value for thickness is taken.

For stacked layers on a slide, the same formulas are used in the same manner, but q is the volumetric flow rate per unit width of the composite layer and the rheological parameters are those of the layer adjacent to the slide surface.

The computation of Eq. 4 is of greater predictive value when the offset of the air interface is normalized by the thickness on the upper slide surface, $D_u$. Thus, a normalized, dimensionless free-surface drop w may be defined as $$w = \frac{F}{D_u} = \frac{O + D_u - D_l}{D_u} \quad \text{Eq. 7}$$

Bubble traps and recirculations are to be expected when w is sufficiently large; the critical value was determined through experimental observations.

Experiment: Two aqueous gelatin liquid compositions containing surfactant were delivered through a hopper having slides 64, 66 and an exit slot 62, with a first layer 72 issuing from the slot and a second layer 74 flowing down the upper slide 64, as shown in FIGS. 4 and 5. Air bubbles were supplied to the flowing layers. The flow rate of the upper layer 74 was decreased until a line of bubbles 70 was trapped, as shown in FIG. 3. The upper layer flow rate was then fixed, and the flow rate of bottom layer 72 was increased until all bubbles were released.

Figure 7:
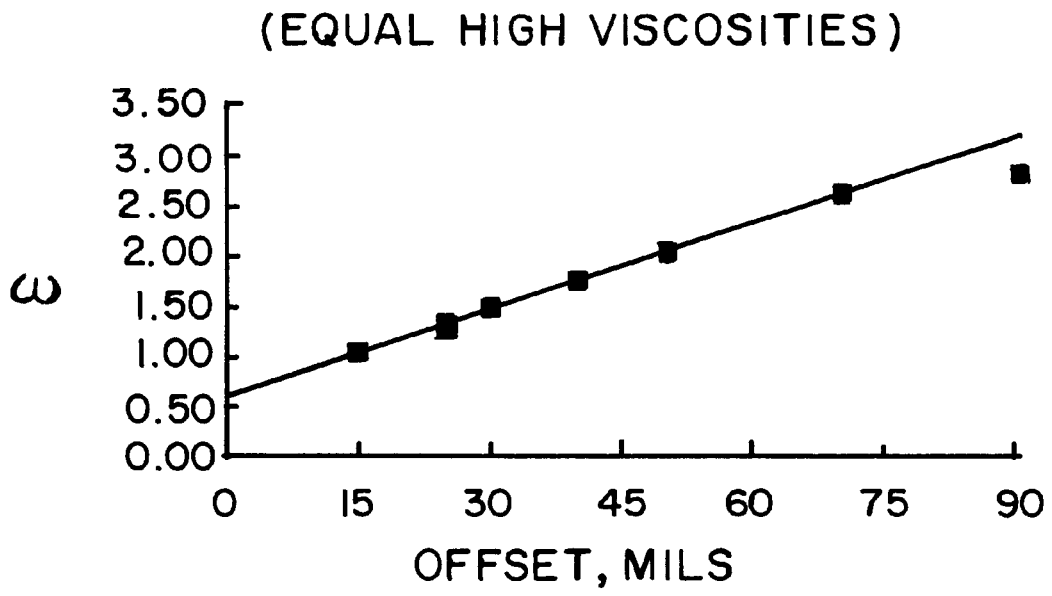
FIG. 7 is a plot of $F/D_u$, versus slide offset where viscosities of the upper and lower layers are high and equal, the region below the curve being immune from bubble trap formation.

Results: Referring to FIG. 7, wherein the viscosities of the liquids are high and equal and range from 0.19 to 0.60 poise, the straight-line relationship shown for w as a function of offset height O is $$w = 0.61 + (0.029)O (O \text{ is in mils}) \quad \text{Eq. 8}$$

Thus, the condition for no bubble traps is $$w \leqq 0.61 + (0.029)O (O \text{ is in mils}) \quad \text{Eq. 9}$$

Figure 8:
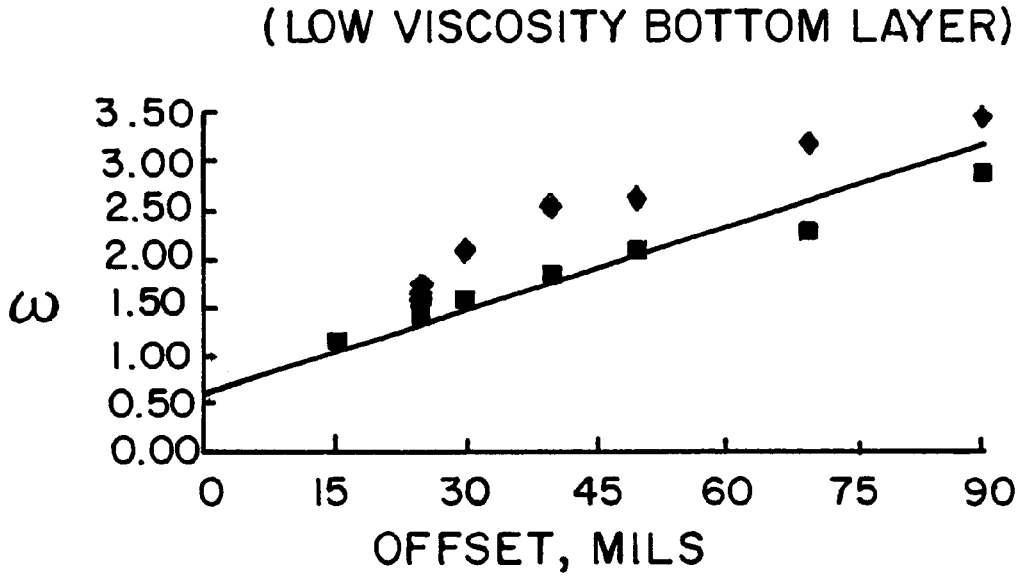
FIG. 8 is a plot like that shown in FIG. 7 where the upper layer viscosity is high and the lower layer viscosity is low, showing results for high and low flow rates of the bottom layer.

In multilayer coating, viscosities preferably have about the same value on the hopper slide to minimize the amplification of waves (U.S. Pat. No. 5,376,401), that value being between about 20 and 200 centipoise. A common exception is bead coating, wherein the viscosity of the bottom layer, the layer formed nearest the bottom end of the slide, may be substantially less than the other layers to promote high speed coating. Referring to FIG. 8, wherein the viscosity of top layer 74 is 0.2 poise and the viscosity of bottom layer 72 ranges from 0.022 to 0.067 poise, when the bottom layer flow rate is very low, the value of w expected from Eq. 8 is obtained. As bottom layer flow rate is increased, however, the value of w obtained also increases, as shown in FIG. 8, where the square symbols are for the lowest bottom-layer flow rates and the diamond symbols are for the highest bottom-layer flow rates. Thus, using Eq. 9 to determine acceptable conditions at a slot exit gives a safe estimate for offset height.

The air interface may similarly become too curved if the offset is too low or negative. Negative offsets are not of interest because positive offsets are required for a slot exit to function as a backland in accordance with an aim of a versatile hopper. A useful criterion, therefore, is requiring that w be greater than zero; the air interface is nearly flat when w=0. Therefore, the full requirement for a slot exit that is not a backland is $$0 \leqq w \leqq 0.61 + (0.029)O (O \text{ is in mils}) \quad \text{Eq. 10}$$

As described supra, it is an object of the invention to provide a hopper wherein each slide offset can function either as a flow offset within a coating stack or as a suitable backland at the top of a coating stack.

There is no established guideline in the known art for the height of the slide offset at the highest filled slot of a hopper, such as the offset forming backland 39 in FIG. 1. Typically, the backland offset on known hoppers is about 2.5 mm. Such a high backland height effectively prevents the coating composition from wetting the slide above the exit, and makes it easier to clean contamination on the surface above the slot exit. A 2.5 mm backland is low enough, however, that the wetting line can reach the upper edge and become attached there along a straight line. Lower backlands are not generally used because of increased risk of an irregular or jagged wetting line forming on the surface above the edge, which can cause streaks in certain products.

However, an offset as high as 2.5 mm can result in a highly curved meniscus in the top layer T attachment and a consequent bubble trap, which in turn can result in a coated thickness non-uniformity. Moreover, such a high offset will generally fail to provide a suitable offset for a slot exit internal to a stack of layers.

Figure 9:
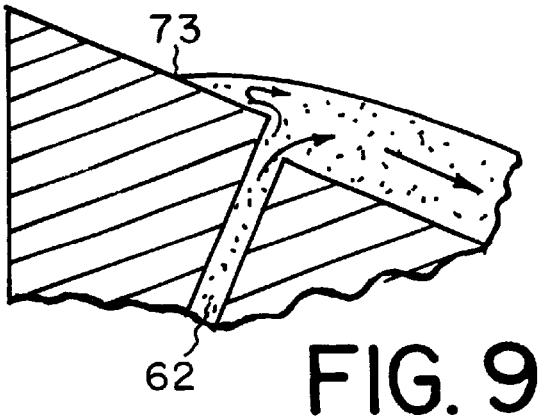
FIG. 9 is a view like that shown in FIG. 2, showing undesirable wetting of the hopper surface above the intended backland.
Figure 10:
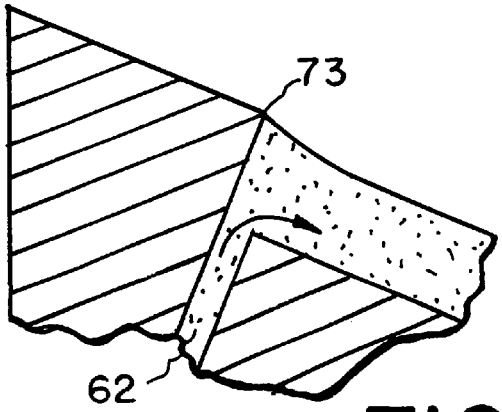
FIG. 10 is a view like that shown in FIG. 9, showing proper wetting of a hopper backland.

For the highest filled slot, the wetting line 73 should be pinned to the edge of the slot, as shown in FIG. 10. If the wetting line migrates onto the dry slide surface, as shown in FIG. 9, its shape may be irregular and coated nonuniformities called streaks may result in some coatings. The desired configuration can always be established if the fully developed thickness $D_l$ of the top layer T on the slide does not exceed the height of the slot offset O for an offset being used as a backland, $$\frac{D_l}{O} \leq 1 \quad \text{Eq. 11}$$

For a versatile hopper, all slot exits will usually have the same offset although this is not essential. Eq. 10 is used to compute whether proposed conditions are advantageous at each exit for each proposed product and speed assuming that the layer is supplied to the minimum number of slots required to meet the restriction on slot Reynolds number taught by Devine (Eq. 3). Offset values are tried until proposed conditions for each slot exit meet the criteria. If a satisfactory offset value cannot be found, it is generally because the height required for a backland is too high when that slot exit is used for the merging of layers. In that case, the top layer requiring a high offset can be supplied to two or more slots to reduce the required backland height.

The same criteria can be applied to an existing hopper that may be used for a new application. Again, a layer is initially assigned to the fewest number of slots needed to meet the restriction on slot Reynolds number taught by Devine. Again, it is sometimes of benefit to supply a layer to additional slots to meet all criteria. If the offsets are too high, however, the criteria may not be satisfied at each exit and the proposed use of the hopper may not be advantageous.

Thus, a method for determining suitable hopper bar offsets for a versatile hopper wherein the offsets may alternatively be used as backlands comprises the steps of:

a) supplying the volumetric flow rate for each coating composition to one or more adjacent hopper elements such that the value of the slot Reynolds number (Re) for each slot is less than 10, where $$Re = \frac{\rho q_s}{\mu_s};$$

b) calculating the thickness of the composite layer on the slide above an exit ($D_u$) and on the slide below an exit ($D_l$) where $$D = \left[\frac{3\mu q}{\rho G \sin(\theta)}\right]^{\frac{1}{3}}$$

for a Newtonian composition and $$D = \left[q\left(2 + \frac{1}{n}\right)\left(\frac{M}{\rho G \sin(\theta)}\right)^{\frac{1}{n}}\right]^{\frac{1}{(2+\frac{1}{n})}}$$

for a shear-thinning composition, wherein q is the volumetric flow rate per unit width of the composite layer and wherein the properties correspond to the coating composition adjacent the slide; and c) selecting an offset value (O) where the value satisfies the condition on $w=(O+D_u-D_l)/D_u$ that $0 \leqq w \leqq 0.61+(0.029)\,O$ (O being expressed in mils), or, for the case of a top layer, $D_l/O<1$.

Backlands provided by this method are generally much lower than the typical known backland of 2.5 mm and can be more difficult to prepare properly such that the top layer wets only to the upper corner of the backland and not the hopper surface above it.

Figure 11:
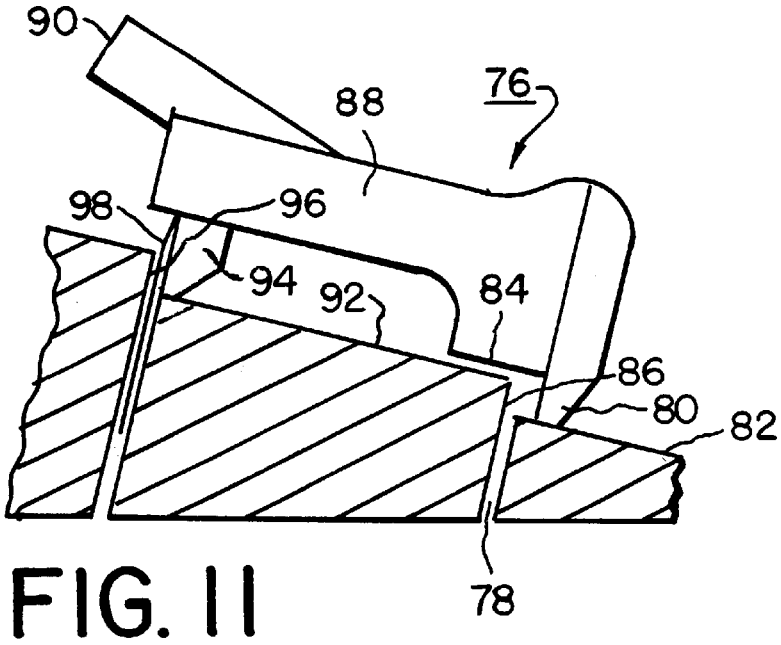
FIG. 11 is a view like that shown in FIG. 9, showing a novel tool for reliably preparing a correctly-wetted backland.

The backland and hopper surface may be cleaned and prepared for attachment of a top layer by directing a stream of high-velocity air in a direction against those surfaces and down the slide progressively across the width of the hopper. A pressurized air nozzle may be used. Alternatively, the air stream may be formed and properly directed by a suction tool. A manually-operable suction tool 76 for preparing an intermediate slot exit 78 as a backland is shown in schematic cross-section in FIG. 11. Tool 76 has a guide 80 for riding on the slide surface 82 below slot 78 and a vacuum snout 84 recessed from guide 80 by at least the height of offset 86. Tool 76 has a hollow body 88 and nipple 90 connectable to a vacuum source for providing a vacuuming action to offset 86 and the lower portion of slide surface 82 adjacent to offset 86. The back end 94 of tool 76 runs against offset 96 of the next slot higher on the hopper as an index to position the tool. Preferably, a plastic shim 98 is extended from the tool into the dry exit slot for enhanced positioning during traverse of the tool. The shim preferably is slightly thinner than the height of the secondary slot, for example, a 15 mil shim may be used for a 20 mil slot.

In operation, with composition flowing from slot 78, the tool is inserted into the dry slot and is moved manually across exit slot 78 to vacuum away all the liquid which it intercepts issuing from the slot. The tool also draws in air along the upper slide surface, and any liquid on that surface is thus removed. The vacuum is sufficient to expose a portion of the offset next to the tool. This action helps ensure that the wetting line attaches to the edge 91 as the tool passes along the slot.

Example Calculation

Offset: O=0.1 cm; slide angle, θ=15 degrees.

Conditions on upper slide: ρ=1 gm/cc, $\mu_l$=0.4 poise, $\mu_h$=0.01 poise, n=0.7, $\dot{\gamma}_l$=200 1/s.

Conditions on lower slide: ρ=1 gm/cc, $\mu_l$=0.07 poise, $\mu_h$=0.01, n=0.85, $\dot{\gamma}_l$=5000 1/s.

Flow rate on the upper slide is 0.15 cc/s/cm and flow rate from the slot is 1 cc/s/cm so that flow rate of the composite layer on the lower slide is 1.15 cc/s/cm. The slot Reynolds number for this situation is computed as 14.3 in violation of the teachings of Devine (Eq. 3), and so two slots are used instead thereby reducing the slot flow rate to 0.5 cc/s/cm. Flow on the upper slide is Newtonian and the calculated thickness is 0.089 cm. On the lower slide the total flow rate is 0.65 cc/s/cm, flow is Newtonian, and the computed composite thickness is 0.081 cm. The value of w is then computed as 1.23. For the specified offset, the maximum desirable value for w is 1.77. Because w is less than 1.77 and greater than 0, the offset is in accord with the invention. Moreover, the viscosity in the secondary slot is 0.07 poise, and the resulting slot Reynolds number of 7.1 is in accord with the teachings of Devine.

In the case where the liquid on the upper slide is a single layer that issued from a single slot with the same slot height and offset, the ratio of the computed film thickness of 0.089 cm to the offset is 0.89, which is less than 1 and therefore in accordance with the invention. Had the ratio been greater than 1, the layer could have been distributed to 2 or more slots to obtain a ratio value below 1.

Figure 12:
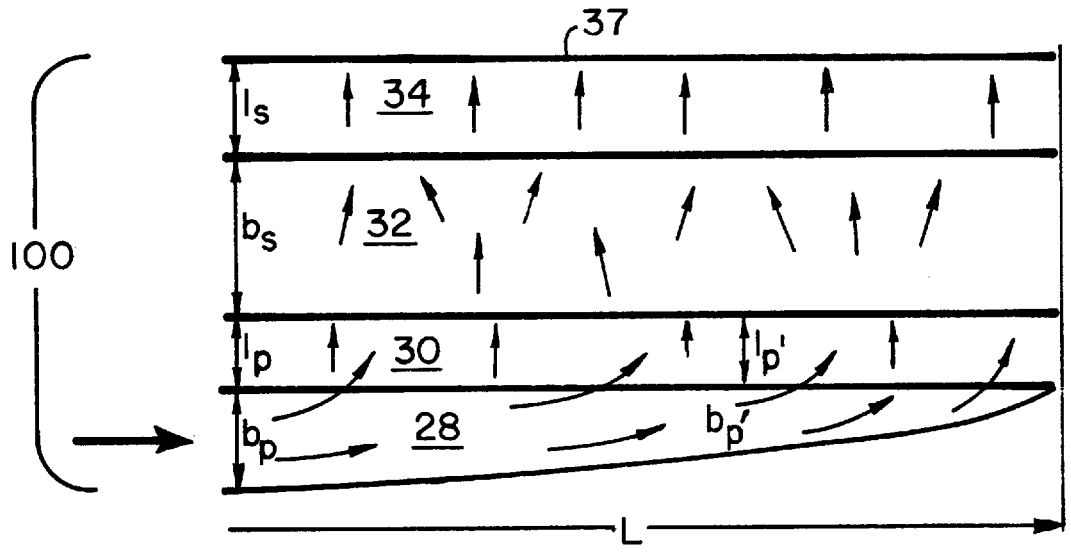
FIG. 12 is a schematic view of the elements of a generic dual-cavity hopper flow system.

The optimization of dimensions within a versatile hopper is now considered. Referring to FIG. 12, the following considerations are important and drive the form of the hopper flow passageways as described infra.

Pressure loss in the primary cavity should be much less than pressure loss in the primary slot. This is achieved primarily through a small slot height and a large cavity cross-sectional area. The pressure loss and velocity loss as the liquid flows (shown by flow arrows) along the primary cavity in the L direction (widthwise of the hopper and of the web to be coated) leads to a falloff in flow from center to edge. Pressure loss in the primary cavity can be reduced by increasing its cross-sectional area; nevertheless, it is still preferable to taper the cross-sectional area from center to end to avoid stagnation at the ends of the cavity. Fluid inertia can also reduce the pressure loss in the primary cavity through recovered pressure as the liquid decelerates, so the worst case of pressure loss is for purely viscous flow. Reducing the length, $l_p$, of the primary slot from center to end of the slot (tapering it in the L direction) can compensate for pressure loss in the primary cavity, but tapering for a versatile hopper must be a compromise over the range of conditions of intended use.

For shear-thinning compositions, viscosities in the slots become lower than viscosities in the cavities because the shear rates in the slot are much higher. The pressure drops in the slots compare less favorably to those in the cavities than for the Newtonian case of no shear thinning, and so shear thinning adversely affects flow distribution. Adverse effects of shear thinning can be compensated by increasing the starting cross-sectional area of the primary cavity and by increasing the taper of the primary slot.

Slot dimensional tolerances dominate the performance of a hopper in accord with the invention. The slots are so narrow that small changes in slot height affect the pressure drop and hence flow distribution. By known fabrication and assembly methods, these tolerances cannot be made negligible, so a design must minimize their effect. The secondary slot is more important than the primary slot because the secondary slot and cavity act to even the flow distribution in the primary slot. However, this distinction is not recognized in known hoppers because the heights of the primary and secondary slots are the same. An important and distinguishing characteristic of the invention is that the height of the secondary slot substantially exceeds that of the primary slot. In this way, the influence of dimensional tolerances is minimized, and the highly uniform distribution required for photographic products is achieved even in the case of significant shear thinning.

The secondary slot height can also be distorted by the bending of the hopper elements by internal fluid pressures.

The obvious way to prevent this, thickening the bars to stiffen them, is not attractive in photographic applications because in multiple slot slide hoppers, slide length is preferably minimized to preclude significant amplification of waves as the superimposed layers flow on the slide. Such waves, known in the art as "slide cross-streaks," appear in a coating as streaks oriented transversely to the coating direction (U.S. Pat. No. 5,376,401). Therefore, the thickness of each hopper bar section typically should not exceed about 3 centimeters. Deep cavities and particularly a deep primary cavity reduce the stiffness of the bar to bending. So, cavity depth preferably is limited so that fluid pressures cannot bend the bars enough to change the heights of the slots. The height of the bars containing the cavities and slots, the total flow length 100, is another important consideration for bar bending. The hopper elements cannot be mechanically connected over the flow length because doing so would disrupt the flow. The longer the flow length, the greater the leverage afforded to internal pressure.

Additionally, there are usually constraints on hopper bar height resulting from curtain height or mechanical interferences from surrounding equipment. In addition, the substantial weight of multiple-bar hoppers complicates their handling and positioning, as well as the materials of fabrication. Thus, it is desirable to minimize the total flow length (smallest cavity diameters and shortest slot lengths) while meeting coating uniformity requirements. Therefore, minimizing total flow length is another important objective.

In light of the many complications and interactions, it is surprising that a single versatile design can accommodate a wide range of coating compositions, from Newtonian to significantly shear thinning. The formula supplied infra gives a straightforward and useful way to identify and scale versatile designs.

The nomenclature for general conditions of the hopper includes:

L half the width of the bilaterally-symmetrical, center-fed primary hopper cavity, substantially one-half the desired coating width;

Z horizontal distance along the hopper from the center in the direction of L; and q volumetric flow rate per unit width.

For the primary cavity and slot, the nomenclature includes:

$h_p$ slot height primary slot;

$A_p$ initial cross-sectional area of primary cavity (usually tapers across the width);

$A_p'$ local cross-sectional area of primary cavity;

t exponent by which the cross section of the primary cavity is tapered $$A_p' = A_p\left(1 - \frac{z}{L}\right)^t \quad \text{Eq. 12}$$

$b_p$ flow length of primary cavity at center $\beta_p$ area of primary cavity divided by the square of its flow length $$b_p = \sqrt{\frac{A_p}{\beta_p}} \quad \text{Eq. 13}$$

$r_p$ aspect ratio of primary cavity, flow length/depth $l_p$ length at center of the bilaterally-symmetrical primary slot (usually tapers across the width)

$l_p'$ local length of the tapering primary slot m primary slot length at end divided by that at center $$l_p' = l_p\left\{1 - (1-m)\left[1 - \left(1 - \frac{z}{L}\right)^{2(1-t)}\right]\right\} \quad \text{Eq. 14}$$

$g_p$ primary geometry ratio $$g_p = \frac{h_p^3 L^2}{l_p A_p^2} \quad \text{Eq. 15}$$

$\mu_p$ viscosity in primary slot $f_p$ primary viscosity ratio $$f_p = \frac{\mu_l}{\mu_p} = \frac{6q^{1-n}}{\dot{\gamma}_l^{1-n} h_p^{2(1-n)}}\left[\frac{n}{2(2n+1)}\right]^n \leq 1 \quad \text{Eq. 16}$$

$E_p$ primary design parameter $$E_p = \frac{g_p(f_p - 1)}{(1-t)} \quad \text{Eq. 17}$$

For the secondary cavity and slot, the nomenclature includes:

$h_s$ height of secondary slot $l_s$ length of secondary slot $A_s$ cross-sectional area of secondary cavity $b_s$ flow length of secondary cavity $\beta_s$ area of secondary cavity divided by the square of its flow length $$b_s = \sqrt{\frac{A_s}{\beta_s}} \quad \text{Eq. 18}$$

$r_s$ aspect ratio of secondary cavity, flow length/depth $g_s$ secondary geometry ratio $$g_s = \frac{h_s^3 L^2}{l_s A_s^2} \quad \text{Eq. 19}$$

$\mu_s$ viscosity in secondary slot $f_s$ secondary viscosity ratio $$f_s = \frac{\mu_l}{\mu_s} = \frac{6q^{1-n}}{\dot{\gamma}_l^{1-n} h_s^{2(1-n)}}\left[\frac{n}{2(2n+1)}\right]^n \leq 1 \quad \text{Eq. 20}$$

$E_s$ secondary design parameter $$E_s = g_s f_s \quad \text{Eq. 21}$$

To fabricate a hopper flow distribution system in accordance with the algorithm of the invention, it is first necessary, as in the slide offset/backland determination supra, to specify the fluid properties of the most shear-thinning composition to be coated. For the most shear-thinning composition to be coated, the following constraints on use of the formula apply:

$$0.6 \leq n \leq 1 \quad \text{Eq. 22}$$

$$\dot{\gamma}_l > 100 \text{ per sec} \quad \text{Eq. 23}$$

The values of n and $\dot{\gamma}_l$ are readily obtained by anyone of average skill in the coating art using a commercially available viscometer or rheometer.

The value of the half-width L of the coating is not restricted beyond being within known coating widths; the algorithm permits scaling for hoppers of coating width. A representative magnitude for L is 1 meter.

Each of the slot dimensions and cavity aspect ratios is specified for input to the algorithm. Each has a preferred value, as indicated in Table I below, and a range within which acceptably uniform layers will result. Any value within the indicated range for any parameter may be combined with any value within the indicated range for any other parameter. This permits some customization for specific applications.

TABLE 1

| Parameter | Lower limit | Preferred | Upper limit |
|---|---|---|---|
| $r_p$ aspect ratio of primary cavity | 1 | 1.6 | 2 |
| $r_s$ aspect ratio of secondary cavity | 2 | 5 | 7 |
| $h_s$ height secondary slot | 0.015 inch<br>0.038 cm | 0.020 inch<br>0.051 cm | 0.030 inch<br>0.076 cm |
| $h_p$ primary slot height | 0.007 inch<br>0.018 cm | 0.010 inch<br>0.025 cm | 0.012 inch<br>0.030 cm |
| $l_s$ secondary slot length | 1 cm | 1.7 cm | 2.5 cm |
| $l_p$ primary slot length | 0.5 cm | 1 cm | 2 cm |
| t | 0.4 | 0.525 | 0.6 |
| $E_s$ | 0.10 | 0.23 | 0.30 |
| $E_p$ | 0.005 | 0.025 | 0.1 |

Figure 14:
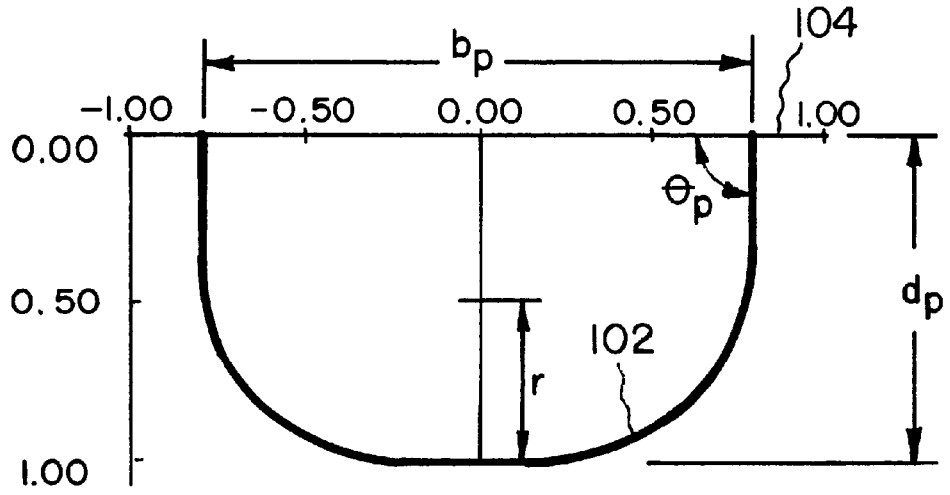
FIG. 14 is a schematic cross-sectional view of a primary hopper cavity in accordance with the invention.

The preferred shape for the cross-section of a primary cavity, as shown in FIG. 14, has an aspect ratio $r_p$ (flow length $b_p$ to depth $d_p$) of about 1.6:1. The range considers both total flow length, increased by larger ratios, and cavity depth, increased by smaller ratios.

Additionally, the wall 102 of the primary cavity preferably intersects the primary slot wall 104 at a well defined angle $\theta_p$ so that the length $l_p$ of the primary slot can be accurately determined. Otherwise, cavity wall 102 is preferably a smooth curve without well-defined corners. The cavity preferably is generally rectangular in shape, the two corners opposite the slot preferably being rounded to preclude relatively stagnant regions. The radius of curvature r for this rounding is preferably no more than about half the depth of the cavity.

Figure 15:
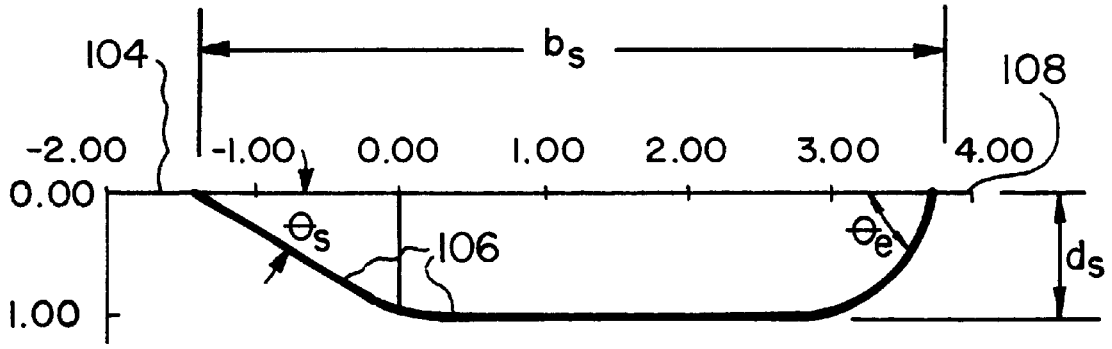
FIG. 15 is a schematic cross-sectional view of a secondary hopper cavity in accordance with the invention.

The preferred shape for the cross-section of a secondary cavity, as shown in FIG. 15, has an aspect ratio $r_s$ (flow length $b_s$ to depth $d_s$) of about 5:1. Additionally, the wall 106 of the cavity preferably intersects the primary slot wall 104 at a well defined angle $\theta_s$ so that the length of the primary slot $l_p$ can be accurately determined. Otherwise, cavity wall 106 is preferably a smooth curve without well defined corners. As disclosed in U.S. Pat. No. 5,234,500 supra, the cavity follows a gradual expansion from the primary slot; an expansion angle of about 30 degrees is preferred. If the expansion is too rapid, regions of flow recirculation and stagnation may occur. Recirculation and stagnation may undesirably collect debris and increase residence and purging times. Following the expansion region, the cavity shape is generally rectangular with the corners opposite the primary and secondary slots preferably being rounded to preclude a relatively stagnant region. The radius of curvature for this rounding is preferably no greater than the cavity depth. Preferably, the wall 106 of the cavity intersects the exit slot wall 108 at a well defined angle $\theta_e$ so that the length of the exit slot $l_s$ can be accurately determined.

The choices for slot length, and in particular for slot height, are dominated by the need to reduce the effects of fabrication tolerances as discussed supra. A relatively large slot height is advantageous because it reduces the percent effect of dimensional tolerances. Increasing the height of the secondary slot substantially over the height of the primary slot significantly reduces the influence of the dimensional tolerances on final flow distribution (see values selected for $h_s$ and $h_p$ supra, wherein the height of the secondary slot is double the height of the primary slot). Although this change reduces the pressure loss in the secondary slot which distributes the liquid composition across the width of the coating, a net gain in widthwise flow distribution is obtained because of the reduction in the effect of dimensional tolerances. A second critical dimension is the slot length, which length must be sharply delineated at both ends because the length must be precise.

According to the invention, a hopper design may be scaled according to viscosity ratios $f_p$ and $f_s$ reflecting intended use and the geometry ratios $g_p$ and $g_s$. The values of the geometry ratios are in effect adjusted by the viscosity ratios to maintain uniform flow distribution and a total flow length less than about 10 cm. The significance of the geometry ratio to hopper performance and the detrimental effect of shear-thinning have long been known for single-cavity hoppers; see, for example, "Flow of Melts in 'Crosshead'-Slit Dies; Criteria for Die Design," *J. of Applied Physics*, Vol. 25 (1954), pp. 1118–1123. However, the use of the geometry ratios for specifying dual-cavity hoppers and the modification of the geometry ratios to accommodate shear-thinning compositions has not heretofore been disclosed.

The viscosity ratios $f_p$ and $f_s$ are unity for Newtonian compositions and become greater than unity for shear-thinning compositions. The greatest shear thinning occurs in the slots, and preferably the cavities are large enough in cross-section that little shear thinning occurs there.

The geometry ratios are advantageously adjusted to accommodate shear thinning by increasing the cross-sectional areas of the cavities. Cavity area, $A_p$ or $A_s$, affects the geometry ratio, $g_s$ or $g_p$, inversely squared. In addition, cavity flow length, $b_p$ or $b_s$, affects area as a square. The net result is that the cavity flow length enters the geometry ratio as the fourth power of the flow length, and it this situation that allows a hopper to be scaled for a wide range of flow conditions by changing the total flow length modestly.

With values of the variables in Table I selected, the values of the remaining variables are computed as follows.

The smallest contemplated value for the power-law index, n, is specified consistent with $0.6 \leqq n \leqq 1$. Similarly, the smallest contemplated value for the shear rate at the onset of shear thinning according to the truncated power-law model, $\dot{\gamma}_l$, is specified consistent with $\dot{\gamma}_l > 100$ per sec. Also, the highest contemplated flow rate through a single slot at these extreme values for n and $\dot{\gamma}_l$ is specified. These three values together with the previously selected values for the slot heights $h_p$ and $h_s$ permit the maximum shear-thinning conditions for the design, quantified by the viscosity ratios $f_p$ and $f_s$, to be determined.

$$f_s = \frac{6q^{1-n}}{\dot{\gamma}_l^{1-n} h_s^{2(1-n)}} \left[\frac{n}{2(2n+1)}\right]^n \quad \text{Eq. 24}$$

$$f_p = \frac{6q^{1-n}}{\dot{\gamma}_l^{1-n} h_p^{2(1-n)}} \left[\frac{n}{2(2n+1)}\right]^n \quad \text{Eq. 25}$$

From these extreme values for $f_p$ and $f_s$, the geometry ratios are computed.

$$g_s = \frac{E_s}{f_s} \quad \text{Eq. 26}$$

$$g_p = \frac{1-t}{f_p - 1} E_p \quad \text{Eq. 27}$$

The value for $g_p$ is limited as follows $$\frac{g_p}{1-t} \leq 0.07 \quad \text{Eq. 28}$$

The values so determined for the geometry ratios $g_p$ and $g_s$, in turn, determine the cross-sectional areas of the cavities $$A_s = \sqrt{\frac{h_s^3 L^2}{l_s g_s}} \quad \text{Eq. 29}$$

$$A_p = \sqrt{\frac{h_p^3 L^2}{l_p g_p}} \quad \text{Eq. 30}$$

These values for the areas $A_p$ and $A_s$ determine the flow lengths of the cavities $$b_s = \sqrt{\frac{A_s}{\beta_s}} \quad \text{Eq. 31}$$

$$b_p = \sqrt{\frac{A_p}{\beta_p}} \quad \text{Eq. 32}$$

Finally, the preferred value for the fractional tapering of the primary slot is computed $$m = 1 - \frac{g_p(1+f_p)}{1.5(1-t)} \quad \text{Eq. 33}$$

The resulting design applies to flow conditions that meet the following criteria:

1. The power-law index is equal to or exceeds the value used in the formula (the value used in Eqs. 24 and 25).
2. The shear rate for the onset of shear thinning $\dot{\gamma}_l$ is equal to or exceeds the value used in the formula (the value used in Eqs. 24 and 25).
3. The flow rate is such that the corresponding viscosity ratio $f_s$ is less than or equal to that value determined by the formula (Eq. 24).
4. The flow rate is such that the viscosity ratio $f_p$ is less than or equal to the value determined by the formula (Eq. 25).

EXAMPLES

Example 1

Table II shows the results of calculations according to the above formula for essentially the preferred values of Table I and for cavities of the preferred shape for two applications differing in their shear-thinning limits. The preferred values are more advantageous for flow distribution and total flow length, but any values within the claimed ranges produce good uniformity with comparable flow lengths. The contemplated degree of shear thinning is less extreme (more Newtonian) in the second case. This is quantified by the smaller values of $f_s$ and $f_p$ in the second case. Indeed, in the second case, the liquid shear thins in the primary slot but not in the secondary slot. The cross-sectional areas of the cavities are larger in the first case to accommodate the more extreme degree of shear thinning; the area of the primary cavity is substantially affected. However, in both cases the total flow length less than 10 cm. In the second case, the constraint of Eq. 28 applies.

TABLE II

| Parameter | Case 1 | Case 2 |
|---|---|---|
| q | 0.5 cc/s/cm | same |
| $\dot{\gamma}_l$ | 100 $sec^{-1}$ | 1000 $sec^{-1}$ |
| n | 0.6 | 0.8 |
| L | 70 cm | same |
| $r_s$ | 5.2 | same |
| $\beta_s$ | 0.157 | same |
| $r_p$ | 1.59 | same |
| $\beta_p$ | 0.561 | same |
| $h_s$ | 0.020 inch<br>0.051 cm | same |
| $h_p$ | 0.010 inch<br>0.025 cm | same |
| $l_s$ | 1.7 cm | same |
| $l_p$ | 1 cm | same |
| t | .525 | same |
| $E_s$ | 0.23 | same |
| $E_p$ | 0.025 | same |
| $f_s$ | 2.365 | 1 |
| $f_p$ | 4.118 | 1.276 |
| $g_s$ | 0.095 | 0.23 |
| $g_p$ | 0.0039 | 0.033 |
| $A_s$ | 2.00 sq cm | 1.30 sq cm |
| $A_p$ | 4.56 sq cm | 1.56 sq cm |
| $b_s$ | 3.56 cm | 2.87 cm |
| $b_p$ | 2.85 cm | 1.67 cm |
| m | 0.973 | 0.896 |
| total flow length | 9.10 cm | 7.23 cm |

The following application is proposed for case 1: $\dot{\gamma}_l$=500 per sec, n=0.75, $\mu_l$=100 cp, $\mu_b$=3 cp, and q=1 cc/s/cm. The specified power law index is greater than 0.6, and the specified shear rate for the onset of shear thinning is greater than 100. Moreover, the viscosity ratio for the primary slot for the proposed application, computed to be 1.92, is less than the limiting value of 4.12, and the viscosity ratio for the secondary slot, computed to be 1.36, is less than the limiting value of 2.37. So, the proposed coating composition and flow rate are suitable for case 1. However, the degree of shear thinning is too great to be accommodated by case 2.

Example 2

A versatile curtain-coating hopper comprising 9 elements, nominally identical internally, was built in accordance with the invention. The primary slot height was 0.01 inches (0.025 cm) and the secondary slot height was 0.02 inches (0.051 cm) as preferred. The expanding secondary cavity is in accordance with U.S. Pat. No. 5,234,500. The semi-circular primary cavity is within the scope of the invention and suffices for applications with moderately shear thinning coating compositions. Test compositions varying in rheological properties were formulated of water, gelatin, thickening agent (a copolymer of 20% acrylimide and 80% 2-acrylamido-2-methylpropane sulfonic acid sodium salt), and a carbon dispersion to provide optical density. The conditions are summarized in Table III. The parameters fall within the specified ranges of the invention. Reflecting the moderate shear thinning contemplated, the primary geometry ratio has the value determined by the constraint given by Eq. 28. Test composition was supplied to one element of the hopper. Aqueous gelatin containing surfactant as required for curtain coating and having negligible optical density was supplied to all other elements. The test composition could be moved among the slots. The uniformity of the test composition was determined by measuring the optical density across coated and dried samples.

An essentially Newtonian test composition, case 1 in Table III, was supplied from slot 2 with a measured peak-to-peak nonuniformity of 0.78% and from slot 4 with a nonuniformity of 0.67%. Reflecting the compromise tapering of the primary slot, the distribution was heavier at the edges of the coating. A moderately shear-thinning composition, case 2 in Table III, was supplied from slot 2 with a peak-to-peak nonuniformity of 1.38% and from slot 4 with a nonuniformity of 0.82%. Reflecting the compromise tapering of the primary slot, the distribution was heavier at the center of the coating.

Nominally identical hopper elements under nominally identical conditions generally do not produce identical flow distributions. An important reason for this is differences in dimensional tolerances, which cannot be made insignificant with known fabrication methods as stated above.

This hopper was also versatile for element usage. The offsets were 0.04 inches (1 millimeter) for elements 1–4, 0.05 inches (1.3 millimeter) for elements 5–8, and 0.07 inches (1.8 mm) for element 9. Coatings made with one or more unused elements in accordance with the invention showed no concomitant coating nonuniformities.

TABLE

| Parameter | Case 1 | Case 2 |
|---|---|---|
| $q$ | 0.35 cc/sec/cm | 0.35 cc/sec/cm |
| $\gamma_1$ | NA | 111 per sec |
| $n$ | 1 | 0.78 |
| $L$ | 68.6 cm | 68.6 cm |
| $r_s$ | 4.8 | 4.8 |
| $\beta_s$ | 0.163 | 0.163 |
| $r_p$ | 2 | 2 |
| $\beta_p$ | 0.393 | 0.393 |
| $h_s$ | 0.020 inch (0.051 cm) | 0.020 inch (0.051 cm) |
| $h_p$ | 0.010 inch (0.025 cm) | 0.010 inch (0.025 cm) |
| $l_s$ | 1.52 cm | 1.52 cm |
| $l_p$ | 1.40 cm | 1.40 cm |
| $t$ | 0.525 | 0.525 |
| $E_s$ | 0.21 | 0.30 |
| $E_p$ | NA | 0.072 |
| $f_s$ | 1.00 | 1.44 |
| $f_p$ | 1.00 | 1.96 |
| $g_s$ | 0.21 | 0.21 |
| $g_p$ | 0.036 | 0.036 |
| $A_s$ | 1.387 sq cm | 1.387 sq cm |
| $A_p$ | 1.24 sq cm | 1.24 sq cm |
| $b_s$ | 2.92 cm | 2.92 cm |
| $b_p$ | 1.78 cm | 1.78 cm |
| $m$ | 0.885 | 0.885 |
| total flow length | 7.6 cm | 7.6 cm |

Example 3

A hopper section according to prior art has metering slots of the same height, a semi-circular primary cavity, and a secondary cavity that is a section of a circle. Conditions are summarized in Table IV. Flow uniformity was measured for both a substantially Newtonian liquid, aqueous gelatin, case 1 in Table IV, and a shear-thinning liquid, aqueous gelatin plus thickening agent Sodium Polystyrene Sulfonate (Versa TL-502, National Starch), case 2 in Table IV. Flow distributions were obtained that were heavy in the center. For case 1, the peak-to-peak flow nonuniformity was 4.8%, and for case 2, 5.7%. The primary slot height and the shape of the secondary cavity are outside the range of the present invention. The values for $E_s$ lie outside the range of the invention, and $g_p$ is not limited to 0.07(1−t)=0.031 as required. So, the requirements of the present invention are not met, and the flow nonuniformity is larger than desired in demanding applications.

TABLE IV

| Parameter | Case 1 | Case 2 |
|---|---|---|
| $q$ | 0.4 cc/s/cm | 0.4 cc/s/cm |
| $\gamma_1$ | 167 $sec^{-1}$ | 167 $sec^{-1}$ |
| $n$ | 1 | 0.916 |
| $L$ | 67.3 cm | 67.3 cm |
| $r_s$ | 5.5 | 5.5 |
| $\beta_s$ | 0.124 | 0.124 |
| $r_p$ | 2 | 2 |
| $\beta_p$ | 0.393 | 0.393 |
| $h_s$ | 0.020 inch (0.051 cm) | 0.020 inch (0.051 cm) |
| $h_p$ | 0.020 inch (0.051 cm) | 0.020 inch (0.051 cm) |
| $l_s$ | 2.54 cm | 2.54 cm |
| $l_p$ | 2.73 cm | 2.73 cm |
| $t$ | 0.55 | 0.55 |
| $E_s$ | 2.04 | 2.29 |
| $E_p$ | 0 | 0.026 |
| $f_s$ | 1.00 | 1.12 |
| $f_p$ | 1.00 | 1.12 |
| $g_s$ | 2.04 | 2.04 |
| $g_p$ | 0.094 | 0.094 |
| $A_s$ | 0.338 sq cm | 0.338 sq cm |
| $A_p$ | 1.52 sq cm | 1.52 sq cm |
| $b_s$ | 1.65 cm | 1.65 |
| $b_p$ | 1.97 cm | 1.97 |
| $m$ | 0.917 | 0.917 |
| total flow length | 8.89 cm | 8.89 cm |

Example 4

A hopper section according to prior art has metering slots of the same height, a semi-circular primary cavity. The expanding secondary cavity is in accordance with U.S. Patent No. 5,234,500. Conditions are summarized in Table V. Flow uniformity was measured for both a substantially Newtonian liquid, aqueous gelatin, case 1 in Table V, and a shear-thinning liquid, aqueous gelatin plus thickening agent Sodium Polystyrene Sulfonate (Versa TL-502, National Starch), case 2 in Table V. Flow distributions were obtained that were heavy in the center. For case 1, the peak-to-peak flow nonuniformity was 6.5 %, and for case 2, 7.75%. The secondary slot height is outside the range of the present invention. So, the requirements of the present invention are not met, and the flow nonuniformity is larger than desired in demanding applications.

TABLE V

| Parameter | Case 1 | Case 2 |
|---|---|---|
| $q$ | 0.47 cc/s/cm | 0.47 cc/s/cm |
| $\gamma_1$ | NA | 100 per sec |
| $n$ | 1 | 0.74 |
| $L$ | 68.6 cm | 68.6 cm |
| $r_s$ | 4.2 | 4.2 |
| $\beta_s$ | 0.208 | 0.208 |
| $r_p$ | 2 | 2 |

TABLE V-continued

| Parameter | Case 1 | Case 2 |
|---|---|---|
| $\beta_p$ | 0.393 | 0.393 |
| $h_s$ | 0.010 inch (0.025 cm) | 0.010 inch (0.025 cm) |
| $h_p$ | 0.010 inch (0.025 cm) | 0.010 |
| $l_s$ | 2.48 cm | 2.48 |
| $l_p$ | 1.33 cm | 1.33 |
| t | 0.666936 | 0.666936 |
| $E_s$ | 0.02 | 0.05 |
| $E_p$ | NA | 0.221 |
| $f_s$ | 1.00 | 2.46 |
| $f_p$ | 1.00 | 2.46 |
| $g_s$ | 0.02 | 0.02 |
| $g_p$ | 0.050 | 0.050 |
| $A_s$ | 1.273 sq cm | 1.273 sq cm |
| $A_p$ | 1.07 sq cm | 1.07 sq cm |
| $b_s$ | 2.48 | 2.48 |
| $b_p$ | 1.65 | 1.65 |
| m | 0.830 | 0.830 |
| total flow length | 7.9 | 7.9 |

An important advantage of multiple-slot hoppers formed in accordance with the invention is that all of the individual flow distribution systems may be formed identically, in accordance with the most shear-thinning conditions contemplated, which greatly simplifies hopper design, greatly increases versatility, and greatly reduces fabrication costs. When, in addition, slide offsets are in accordance with the invention, such a versatile hopper may be used to coat other combinations of compositions wherein the number of compositions to be delivered is not greater than the number of hopper elements, including wherein the number of compositions is less than the number of elements.

The many features and advantages of the invention are apparent from the detailed specification and thus it is intended by the appended claims to cover all such features and advantages which fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

PARTS LIST

10 prior art multiple-slot dual-cavity extrusion/slide hopper
12 first hopper bar
14 second hopper bar
16 third hopper bar
18 fourth hopper bar
20 lip portion of 18
22 upper planar surface of 14
24 upper planar surface of 16
26 upper planar surface of 18
28 primary cavity for T
30 slot for T
32 secondary cavity for T
34 exit slot for T
35 upper side of 34
36 feed conduit for T
37 upper surface of 12
38 primary cavity for M
39 backland
40 slot for M
42 secondary cavity for M
44 exit slot for M
46 feed conduit for M
48 primary cavity for B
50 slot for B
52 secondary cavity for B
54 exit slot for B
56 feed conduit for B
58 lip
60 drive roller
62 exit slot

PARTS LIST

Continued

64 upper slide
65 layers on 64
66 lower slide
67 layers on 66
68 eddy
70 bubbles
71 first meniscus
71' second meniscus
71" third meniscus
72 first layer
73 wetting line
74 second layer
76 suction tool
78 intermediate exit slot
80 guide of 76
82 slide surface below 78
84 vacuum snout of 76
86 offset of 78
88 hollow body of 76
90 nipple on 88
91 upper edge of 78
92 slide surface above 78
94 back end of 76
96 offset of slot above 78
98 shim
100 total flow length
101 low shear region
102 wall of primary cavity
103 power law region
104 primary slot wall

PARTS LIST

Continued

105 high shear region
106 wall of secondary cavity
108 secondary slot wall

What is claimed is:

1. A coating hopper for dispensing a liquid composition to coat a moving substrate, the coating hopper comprising a primary cavity, a primary slot exiting the primary cavity and communicating with a secondary cavity, and a secondary slot exiting the secondary cavity, wherein the primary slot height $h_p$ is between about 0.018 cm and 0.030 cm, the secondary slot height is between about 0.038 cm and 0.076 cm, the primary slot length is between about 0.5 cm and 2 cm, the secondary slot length is between about 1 cm and 2.5 cm, a tapering factor t is between about 0.4 and 0.6, an aspect ratio of the primary cavity ($r_p$) is between about 1 and 2, an aspect ratio of the secondary cavity is between about 2 and 7, a primary geometry ratio ($g_p$) is between about 0.001 and 0.04, the secondary geometry ratio ($g_s$) is between about 0.03 and 0.3, and a fractional tapering of the primary slot (m) is between 0.9 and 1.

2. A coating hopper in accordance with claim 1 wherein, the slot height of the secondary slot ($h_s$) is greater than the slot height of the primary slot ($h_p$).

3. A coating hopper as recited in claim 1 wherein:

said primary and secondary slots are supplied such that a respective slot Reynolds number of said liquid composition is less than 10, said liquid composition having a shear rate $\dot{\gamma}_l \geqq 100$ l/sec and a power law index $n \geqq 0.6$.

4. A coating hopper in accordance with claim 3 wherein said hopper is an extrusion/slide hopper comprising a plurality of independent composition flow distribution systems, each of said systems having a slide surface adjacent a secondary slot thereof, adjacent slide surfaces of said plurality of slide surfaces being offset to form an intervening offset step, at least one of said offset steps being suitable for use for no layer on the upper slide of said step.

5. A coating hopper in accordance with claim 4 wherein all of said offset steps are less than 0.1 inch.

6. A coating hopper in accordance with claim 1 wherein the slot height of the secondary slot ($h_s$) is about twice the slot height of the primary slot ($h_p$).

7. A coating hopper in accordance with claim 6 wherein the slot height of the secondary slot ($h_s$) is about 0.050 cm and the slot height of the primary slot ($h_p$) is about 0.025 cm.

* * * * *